US006283839B1

(12) United States Patent
Frederick et al.

(10) Patent No.: US 6,283,839 B1
(45) Date of Patent: Sep. 4, 2001

(54) CRYOGEN SHOT BLAST DEFLASHING SYSTEM

(75) Inventors: William R. Frederick, Valley View; Solomon L. Kwi, Lakewood, both of OH (US)

(73) Assignee: AGA Gas, Inc., Independence, OH (US)

( * ) Notice: Subject to any disclaimer, the term of this patent is extended or adjusted under 35 U.S.C. 154(b) by 0 days.

(21) Appl. No.: 09/310,047

(22) Filed: May 11, 1999

(51) Int. Cl.[7] ..... B24C 3/30
(52) U.S. Cl. ..... 451/86; 451/88
(58) Field of Search ..... 451/86, 87, 88, 451/81

(56) References Cited

U.S. PATENT DOCUMENTS

| | | | | |
|---|---|---|---|---|
| 3,008,274 | | 11/1961 | Welter . | |
| 3,768,210 | * | 10/1973 | Johnson et al. | 51/12 |
| 4,312,156 | * | 1/1982 | McWhorter | 451/81 |
| 4,519,812 | | 5/1985 | Brull et al. . | |
| 4,524,548 | * | 6/1985 | Klee et al. | 451/53 |
| 4,598,501 | | 7/1986 | Vasek . | |
| 4,646,484 | | 3/1987 | Brull . | |
| 4,648,214 | | 3/1987 | Brull et al. . | |
| 4,759,156 | * | 7/1988 | Baumgart | 451/95 |
| 4,793,103 | | 12/1988 | Baumgart . | |
| 4,958,466 | * | 9/1990 | Howells | 51/425 |
| 4,979,338 | * | 12/1990 | Schmitz, II et al. | 451/86 |
| 5,205,085 | * | 4/1993 | Urakami | 451/96 |
| 5,556,324 | * | 9/1996 | Shank, Jr. | 451/89 |
| 5,676,588 | | 10/1997 | Frederick et al. . | |
| 5,879,223 | | 3/1999 | Frederick et al. . | |
| 6,059,640 | * | 5/2000 | Stearns | 451/85 |
| 6,099,398 | * | 8/2000 | Jacobson et al. | 451/446 |

* cited by examiner

*Primary Examiner*—Derris H. Banks
(74) *Attorney, Agent, or Firm*—Pearne & Gordon LLP

(57) ABSTRACT

An apparatus for deflashing work pieces includes a pivotable treatment chamber, a throwing wheel which propels particulate media to impact work pieces in the treatment chamber, and a cryogen supply introducing a flow of cryogen to embrittle work pieces in the treatment chamber. A recirculation system includes a separator in communication with the treatment chamber through a plenum chamber, a media hopper in communication with the separator, first and second withdrawal conduits, a supply conduit connecting the withdrawal conduits to the throwing wheel, and a blower connected to the withdrawal and supply conduits for moving gas therein. The first withdrawal conduit is connected to withdraw cryogen gas from the treatment chamber through the separator and the media hopper and pull media from the separator to the media hopper. The second withdrawal conduit is directly connected to the plenum chamber to withdraw gas therefrom.

19 Claims, 7 Drawing Sheets

CRYOGEN SHOT BLAST DEFLASHING SYSTEM

BACKGROUND OF THE INVENTION

The present invention generally relates to a cryogen shot blast system and, more specifically, to a cryogen shot blast system having a recirculation system for particulate media.

Molded articles often have thin pieces of unwanted material extending therefrom called "flash" which must be removed from the articles for the articles to reach their desired final configuration. Removing flash from articles formed from flexible materials such as rubber, plastics, and the like, is difficult in view of the soft, elastic nature of the flexible materials. While various types of mechanical trimming operations have been proposed for use in removing unwanted flash, these methods have proven to be not economical in a number of applications.

In order to simplify and reduce the cost of flash removal, various attempts have been made for freezing or otherwise cooling molded articles to embrittle the thin sectioned flash, whereafter one or a combination of mechanical processes have been utilized to break-off, trim, or otherwise remove the frozen or embrittled flash. Some of these methods have utilized a two-stage process wherein the work pieces to be deflashed are cooled in a first stage to effect flash embrittlement, whereafter the work pieces are vibrated, tumbled, or otherwise mechanically treated in a second stage to break away or otherwise remove the embrittled flash. One method is to use a cryogen material, such as liquid nitrogen, to effect embrittlement of the work piece flash. As utilized herein, the term "cryogen" will be understood to refer broadly to substances which are fluids and are at temperatures of about −60 F. and below.

Two-stage processes of this type are undesirable from several viewpoints. They are time consuming to carry out because cooling the work pieces and removing their flash comprise separate steps that are carried out sequentially rather than concurrently. Inasmuch as the work pieces are cooled only once and will not be cooled again at other stages of the flash removal procedure, adequate time must be devoted at the outset to providing a thorough cooling of the work pieces to assure that they are refrigerated to an extent that their flash will remain embrittled throughout the remainder of the flash removal process. Sometimes the extensive degree of refrigeration which is required results in the generation of undesirable stresses and/or the formation of cracks or other types of structural defects in the work pieces. An equally troubling drawback of the two-stage processes is that, if there is a relatively large quantity of flash to be removed, the work pieces may not remain adequately embrittled during the entire time required for deflashing. Where such is the case, the work pieces are not properly deflashed.

These drawbacks have been overcome by shot-blast deflashing machinery which operate with a single flash embrittling and removing stage. For example, see U.S. Pat. Nos. 4,519,812, 4,598,501, 4,646,484, 4,648,214, and 5,676,588, the disclosures of which are expressly incorporated herein by reference in their entirety. While such machinery performs in an exemplary manner, there is a never ending desire to decrease the required time and/or cost of a deflashing operation. Accordingly, there is a need in the art for an improved cryogen shot-blast deflashing system.

SUMMARY OF THE INVENTION

The present invention provides a cryogen shot-blast deflashing apparatus which overcomes at least some of the above-described problems of the related art. The apparatus includes a treatment chamber for the work pieces, a throwing wheel adapted to propel particulate media into the treatment chamber to impact the work pieces in the treatment chamber, a cryogen supply system for introducing a flow of cryogen into the treatment chamber for embrittling at least selected portions of the work pieces in the treatment chamber, a recirculation system for recirculating particulate media back to the throwing wheel. The recirculation system includes a separator unit in communication with the treatment chamber, a media hopper in communication with the separator unit, a blower connected to the media hopper by a withdrawal conduit, and a supply conduit connecting the blower to the throwing wheel to return pressurized cryogen gas to the throwing wheel. The withdrawal conduit withdraws cryogen gas from the treatment chamber through the separator unit and the media hopper and at the same time pulls particulate media from the separator unit to the media hopper. A particulate media supply system introduces a metered flow of particulate media from the media hopper into flowing cryogen gas in the supply conduit to transport particulate media to the throwing wheel. Preferably, the recirculation system includes a second withdrawal conduit which is connected to the blower and is in communication with the treatment chamber to withdraw cryogen gas from the treatment chamber without passing through the separator unit.

According to another aspect of the present invention, a cryogen shot-blast deflashing apparatus includes a treatment chamber for work pieces, a throwing wheel adapted to propel particulate media into the treatment chamber to impact the work pieces in the treatment chamber, a cryogen supply system for introducing a flow of cryogen into the treatment chamber for embrittling at least selected portions of the work pieces in the treatment chamber, and a recirculation system for returning particulate media and cryogen gas back to the throwing wheel. The recirculation system includes a separator unit in communication with the treatment chamber, a withdrawal conduit in communication with the treatment chamber, a supply conduit connecting the withdrawal conduit and the throwing wheel to return pressurized cryogen gas to the throwing wheel, and a main blower connected to the withdrawal conduit for withdrawing cryogen gas from the treatment chamber and connected to the supply conduit for returning pressurized cryogen gas to the throwing wheel. The apparatus also includes a drop chute connecting the treatment chamber and the recirculation system to direct particulate from the treatment chamber to the separator unit. The drop chute has a downwardly sloped upper surface toward the separator unit and a plurality of spaced-apart openings along the upper surface for introducing streams of pressurized gas to assist movement of particulate through the drop chute from the treatment chamber to the recirculation system. Preferably, a plenum chamber is formed above the separator unit and is in communication with the treatment chamber so that an auxiliary blower can withdraw gas from the plenum chamber and provide pressurized gas to the plurality of openings.

According to yet another aspect of the present invention, a cryogen shot-blast deflashing apparatus includes a cryogenic chamber, a barrel supported within the cryogenic chamber and defining a treatment chamber for the work pieces, a throwing wheel adapted to propel particulate media into the treatment chamber to impact the work pieces in the treatment chamber, a cryogen supply system for introducing a flow of cryogen into the treatment chamber for embrittling at least selected portions of the work pieces in the treatment chamber, and a recirculation system for returning particulate media to the throwing wheel. The barrel is rotatable about a longitudinal axis and is pivotable to a dumping position wherein work pieces in the barrel are dumped from the barrel through an open end of the barrel. The recirculation system includes a separator unit in communication with the treatment chamber, a withdrawal conduit in communication with the treatment chamber, a supply conduit connecting the withdrawal conduit and the throwing wheel to return pressurized cryogen gas to the throwing wheel, and a main blower connected to the withdrawal conduit for withdrawing cryogen gas from the treatment chamber and connected to the supply conduit for returning pressurized cryogen gas to the throwing wheel. The apparatus also includes a drop chute connecting the cryogenic chamber and the recirculation system to direct particulate from the treatment chamber to the separator unit. The drop chute has a downwardly sloped upper surface toward the separator unit. A spacer is located above the drop chute and is adapted to permit particulate to pass therethrough.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
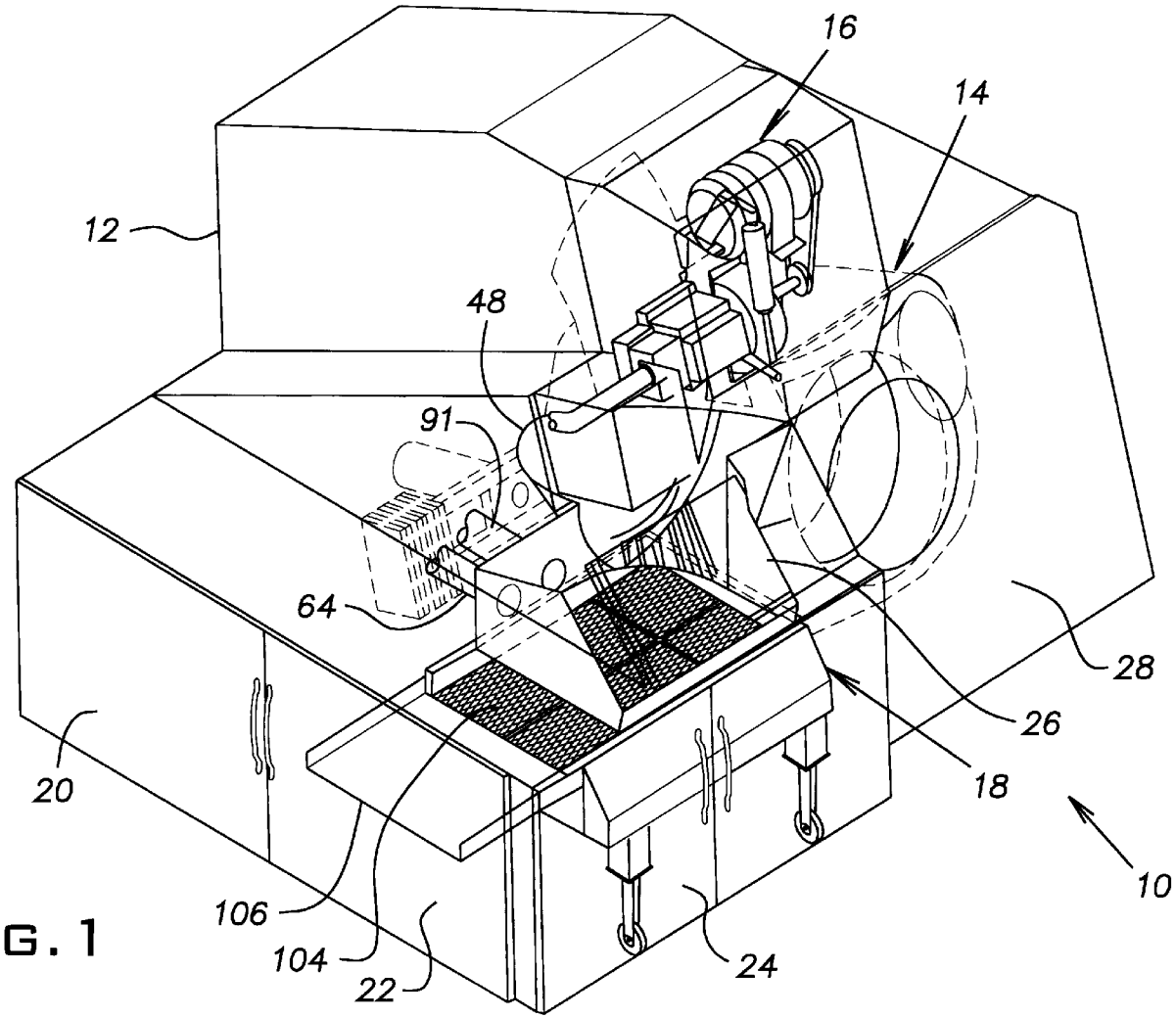
FIG. 1 is a perspective view of a cryogen shot blast deflashing system according to the present invention showing a work-piece barrel in a loading position.
Figure 2:
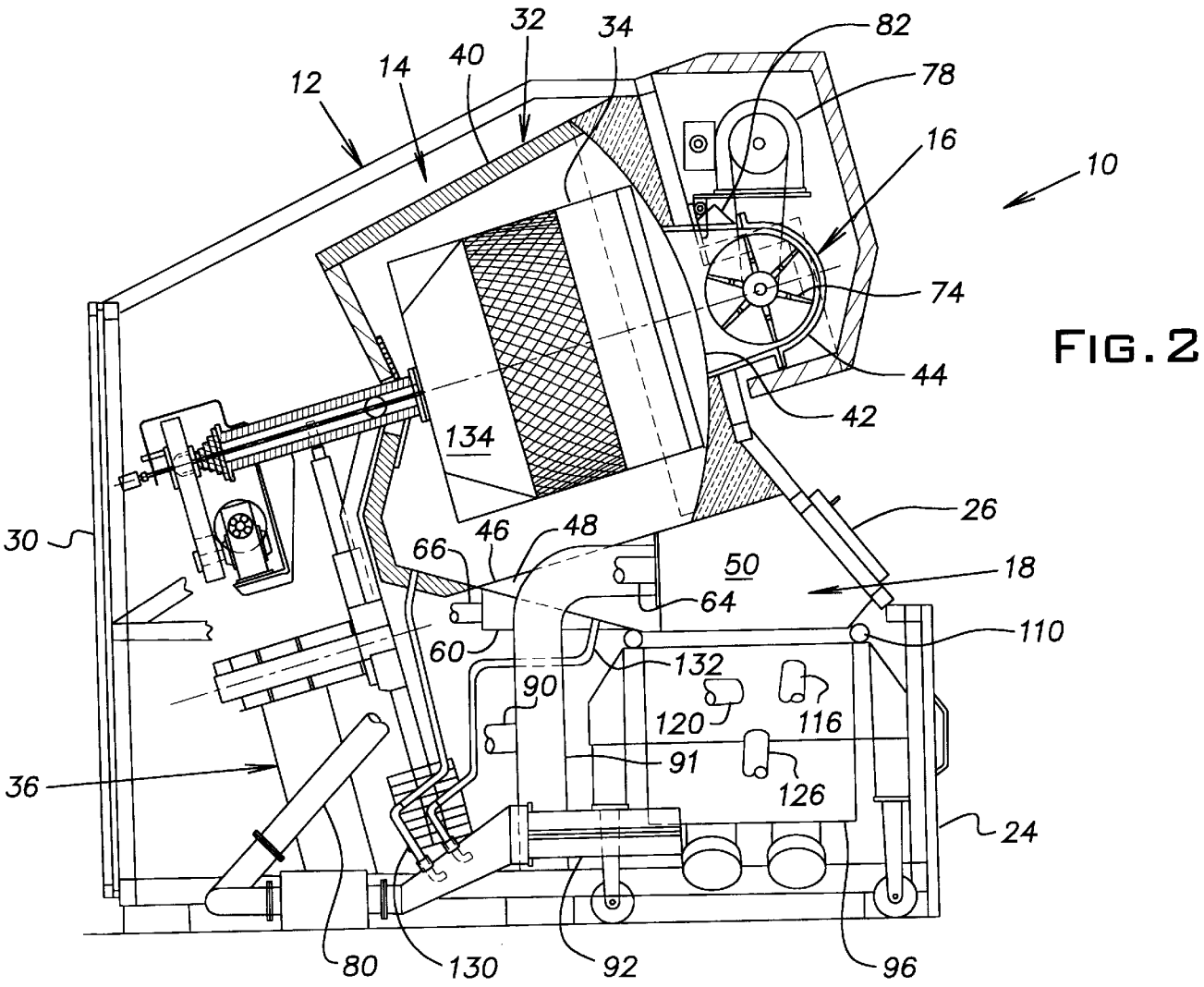
FIG. 2 is a side elevation view, in partial cross-section, of the apparatus of FIG. 1 with elements removed for clarity and showing the work-piece barrel in an operating position.
Figure 3:
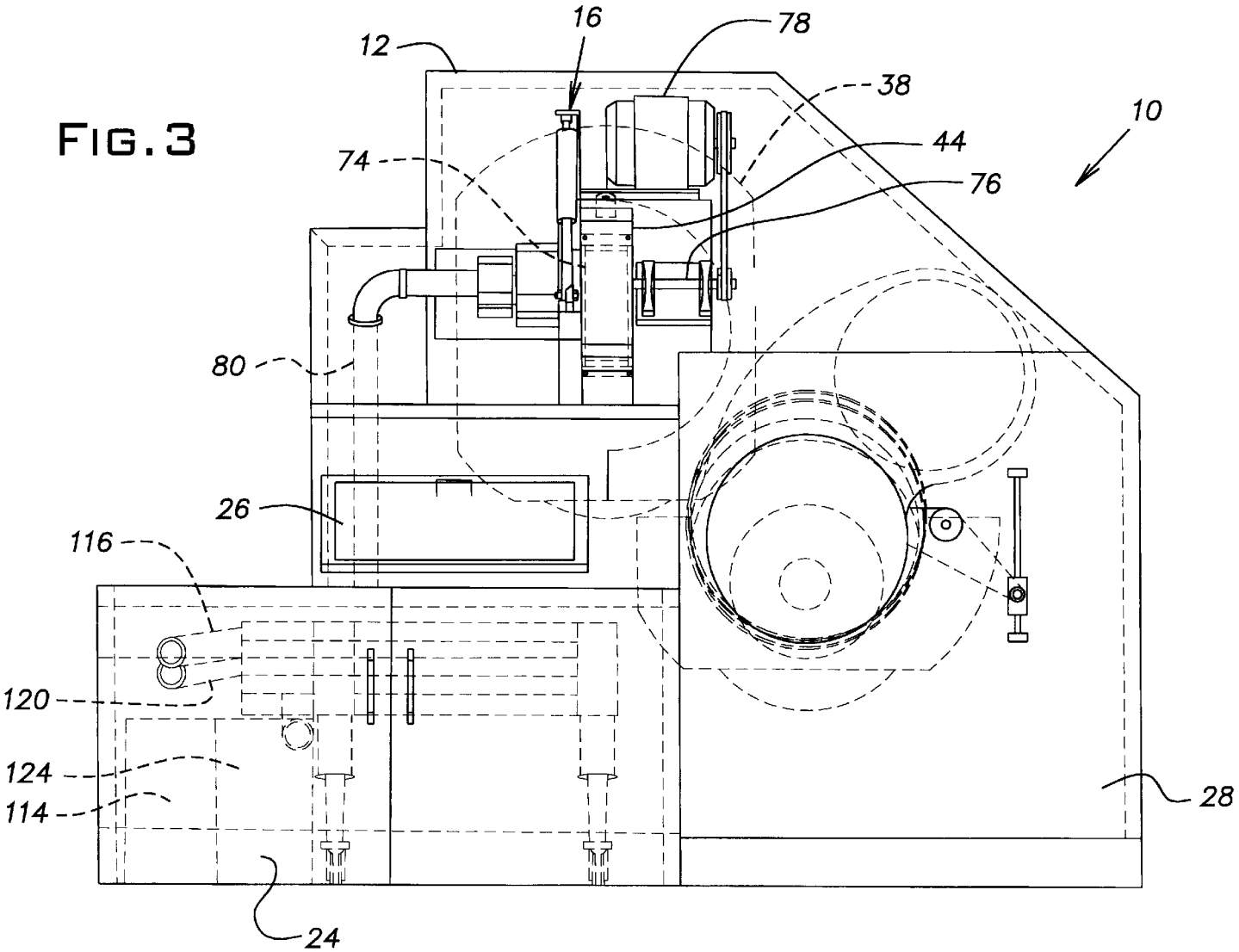
FIG. 3 is a front elevational view of the apparatus of FIGS. 1 and 2 with a throwing wheel cover removed for clarity and showing the work-piece barrel in a loading position.
Figure 4:
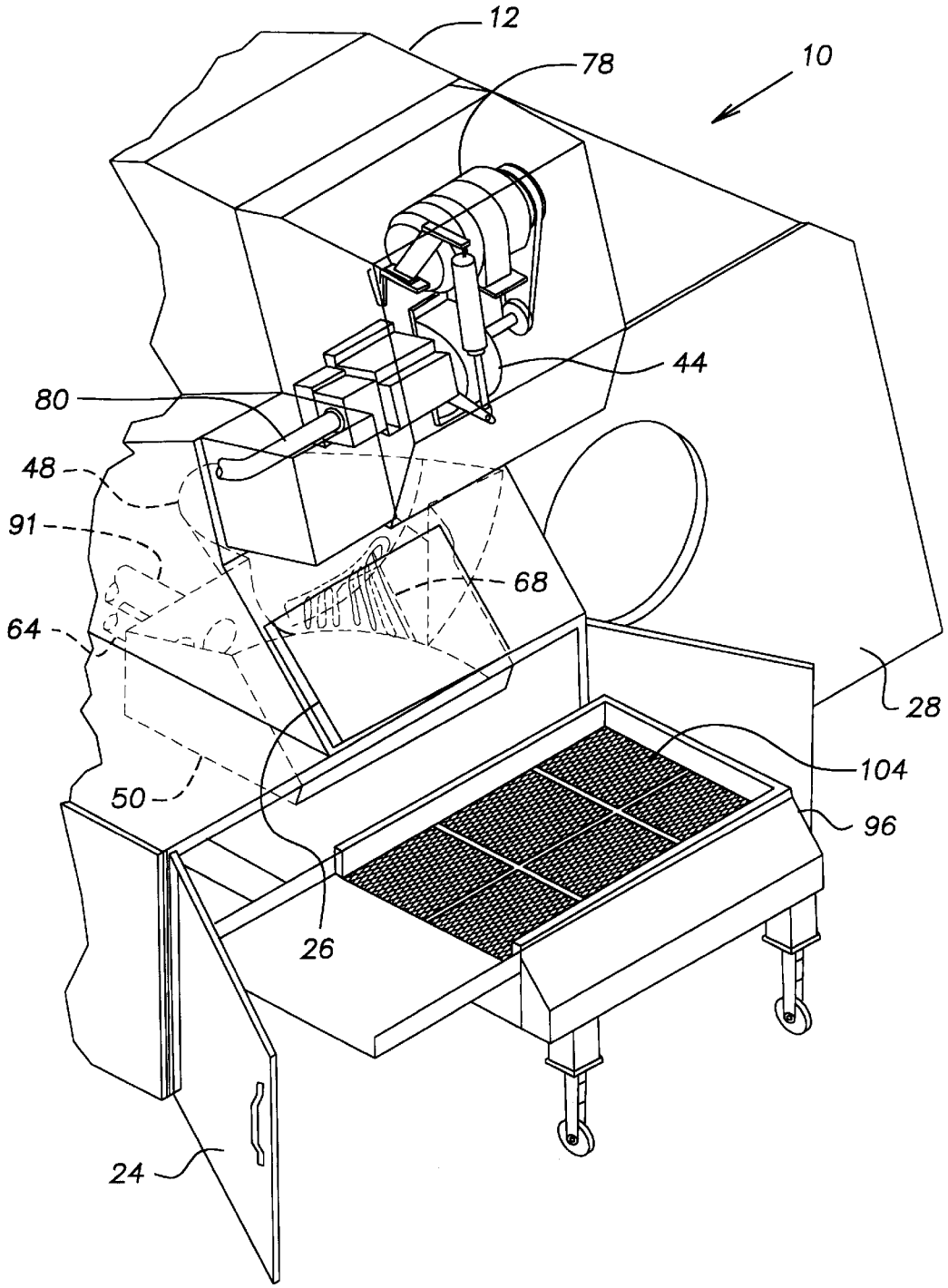
FIG. 4 is an enlarged perspective view of a portion of the apparatus of FIG. 1 but with a separator unit in an auxiliary position.

FIGS. 1–3 illustrate a cryogen shot blast deflashing apparatus 10 according to the present invention. The deflashing apparatus 10 includes a cabinet 12, a receptacle assembly 14, a throwing-wheel assembly 16, and a closed recirculation system 18. The illustrated deflashing apparatus 10 is substantially similar to the deflashing system disclosed in U.S. Pat. No. 5,676,588, the disclosure of which is expressly incorporated herein in its entirety by reference, except for the improvements described hereinbelow in detail. It is noted that the present invention can be utilized with other deflashing systems such as, for example, those disclosed in U.S. Pat. Nos. 4,519,812, 4,598,501, 4,646,484, and 4,648,214, the disclosures of which is expressly incorporated herein in their entirety by reference.

The illustrated cabinet 12 is provided with a plurality of access doors. The cabinet 12 preferably includes a media-bin door 20, a work-piece-bin door 22, a flash-bin door 24, a drop-chute door 26, a main front door 28, and a main rear door 30. As best shown in FIG. 2, the receptacle assembly 14 includes a sealed cryogenic chamber 32, a rotating barrel 34 located within the cryogenic chamber 32, and a support structure 36 for supporting and rotating both the cryogenic chamber 32 and the barrel 34.

The cryogenic chamber 32 includes a generally hemispherically-shaped dome portion 38 and a drum portion 40. Formed at the center of the dome portion 38 is a rectangularly-shaped opening 42 for the throwing-wheel assembly 16. The opening 42 is sealed by a throwing wheel housing 44.

As best shown in FIG. 2, the drum portion 40 is generally frusto-conically shaped with a small-diameter closed end and a large-diameter open end. The rearward end of the drum portion 40 is supported by the support structure 36 such that the forward open end engages the inner surface dome portion 38. It is noted that the forward end surfaces of the drum portion 40 are shaped to conform with the curvature of the inner surface of the dome portion 38. Formed in this manner, the cryogenic chamber 32 is sealed without the use of cryogenic seals or gaskets which require relatively frequent replacement. It is noted that while the cryogenic chamber 32 is sealed to a degree required for operation of the deflashing apparatus 10, the cryogen chamber 32 is not considered to be a pressure vessel.

As best shown in FIGS. 2 and 4–6, the bottom of the drum portion 40 has an opening 46 formed therein which opens into a drop chute 48. The drop chute 48 generally seals the opening 46 and in turn opens into a sealed plenum chamber 50 of the closed recirculation system 18. The plenum chamber 50 has first and second outlets or exits 52, 54 formed in a rear wall thereof as discussed in more detail hereinbelow. It is noted that the drum portion 40 must be separable from the drop chute 48 in order to accommodate rotation of the drum portion 40 between loading and operating positions.

The top surface of the drop chute 48 is generally concave and downwardly angled from the drum portion 40 to the plenum chamber 50 in a channel-shaped manner to direct particulate in a funnel-like manner from the bottom of the drum portion 40 to the plenum chamber 50. The bottom inner surface of the drum portion 40, located rearward of the opening 46, is angled downwardly in a forward direction toward the downwardly-angled drop chute 48 so that a downwardly angled surface is provided substantially without interruption between the drum portion 40 and the plenum chamber 50.

Figure 6:
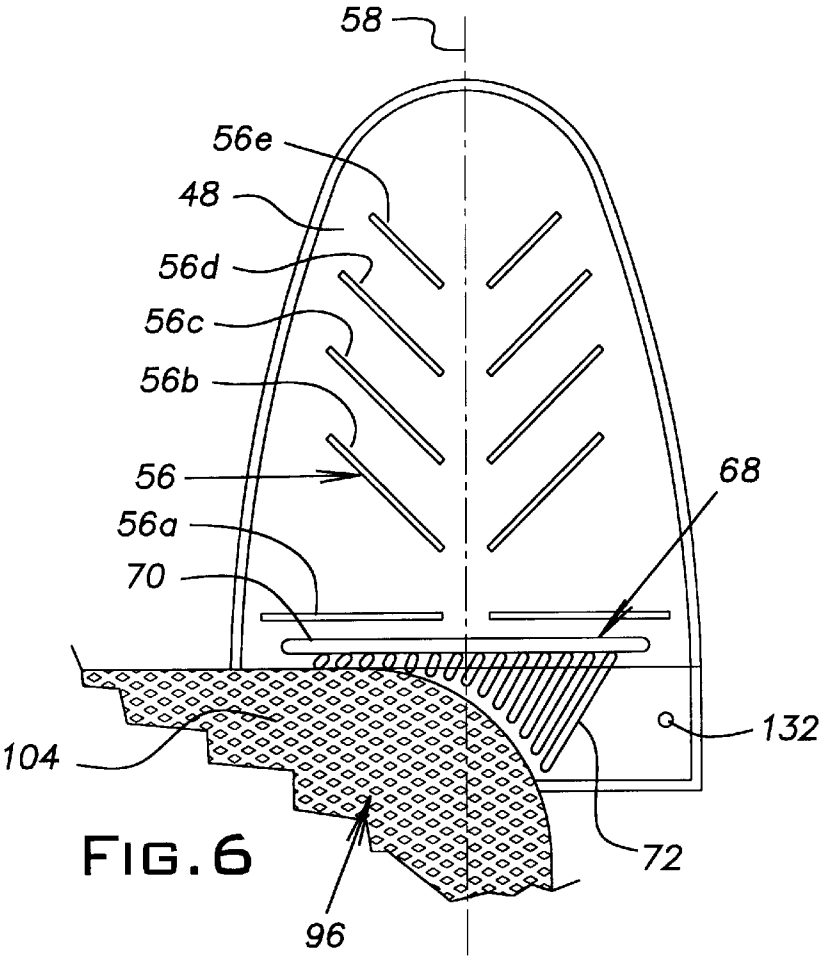
FIG. 6 is a plan view of a drop chute of the apparatus of FIGS. 1–5.

The drop chute 48 is preferably a fluidized bed having a plurality of openings 56 formed therein throughwhich streams of gas outwardly flow to assist movement of particulate media and flash down the drop chute 48 to the plenum chamber 50. Preferably, the openings 56 are in the form of a plurality transversely extending slots spaced apart along the longitudinal axis 58 of the drop chute 48. The illustrated embodiment has five pairs of slots wherein the first pair of slots 56*a*, located at the lower edge of the drop chute 48, is substantially perpendicular to the longitudinal axis 58 and the second to fifth pairs of slots 56*b*–56*e* are each upwardly and outwardly angled relative to the longitudinal axis 58 as shown in FIG. 6. Preferably, the angled slots 56*b*–56*e* are angled about 45° relative to the longitudinal axis 58.

Formed below the drop chute 48 is a sealed drop-chute plenum chamber 60 which provides pressurized gas to the slots 56. Gas is preferably pressurized in the drop-chute plenum chamber 60 by an auxiliary blower 62. A first or inlet conduit 64 extends from the first exit 52 of the recirculation-system plenum chamber 50 to the inlet of the auxiliary blower 62 and a second or exit conduit 66 extends from the outlet of the auxiliary blower 62 to an inlet of the drop-chute plenum chamber 60. Operation of the auxiliary blower 62 pulls gas from the recirculation-system plenum chamber 50 and pressurizes and pushes it into the drop-chute plenum chamber 60. Pressurized gas within the drop-chute plenum chamber 60, exits the drop-chute plenum chamber 60 as a plurality of separate high-velocity flows through the plurality of slots 56*a*–56*e*.

Provided on the drop chute 48 is a spacer 68 which is sized and shaped to be just below the lower-most position of the barrel 34 when the barrel 34 is in a drop or dump position. The spacer 68 of the illustrated embodiment is located at the forward or lower end of the drop chute 48 where it is below the front end of the barrel 34. The spacer 68 has a concave upper surface to cooperate with the curved outer surface of the barrel 34. The spacer 68 is also adapted to permit the flow of particulate media and flash therethrough.

In the illustrated embodiment, the spacer 68 includes a main rod 70 having a curved central portion to form the upper engagement surface. Each end of the main rod 70 is bent and secured to the drop chute 48 such that the curved central portion is spaced above the surface of the drop chute 48. A plurality of spaced-apart secondary rods or fingers 72 extend from the main rod 70 to the front edge of the drop chute 48. The fingers 72 are spaced apart an adequate distance to permit the flow of particulate media and flash therethrough. The spacing of the fingers 72 is preferably 0.5 to 0.75 inches depending on the size and shape of the particular work piece to be deflashed. The main rod 70 and the fingers 72 are preferably stainless steel and are preferably welded to each other and to the drop chute 48. A suitable main rod 70 is a stainless steel rod having a diameter of about 0.375 inches.

As best shown in FIG. 2, the throwing-wheel assembly 16 is supported on the front wall of the cabinet 12 adjacent the opening 42 in the dome portion 38. The throwing-wheel assembly 16 includes a vaned rotor 74 which is enclosed by the surrounding housing 44. As best shown in FIG. 3, a shaft 76 supports the rotor 74 for rotation, and is journalled by graphite bushings and polytetrafluoroethylene (PTFE) rings, such as TEFLON rings. A variable speed motor 78 is supported by the cabinet 12 above the rotor 74 and is drivingly connected to the shaft 76 for rotation.

A supply conduit 80 extends to a nozzle within the impleller or rotor 74 to introduce a flow of cryogen gas and particulate media into the vanes of the rotor 74. Particulate media and cryogen introduced into the vanes are caused to be projected outwardly under centrifugal force as the rotor 74 is turned by the motor 78. Thus, the throwing-wheel assembly 16 operates to direct a flow of particulate media and cryogen gas from the supply conduit 80 into the barrel 34 for impacting the work pieces.

Figure 8:
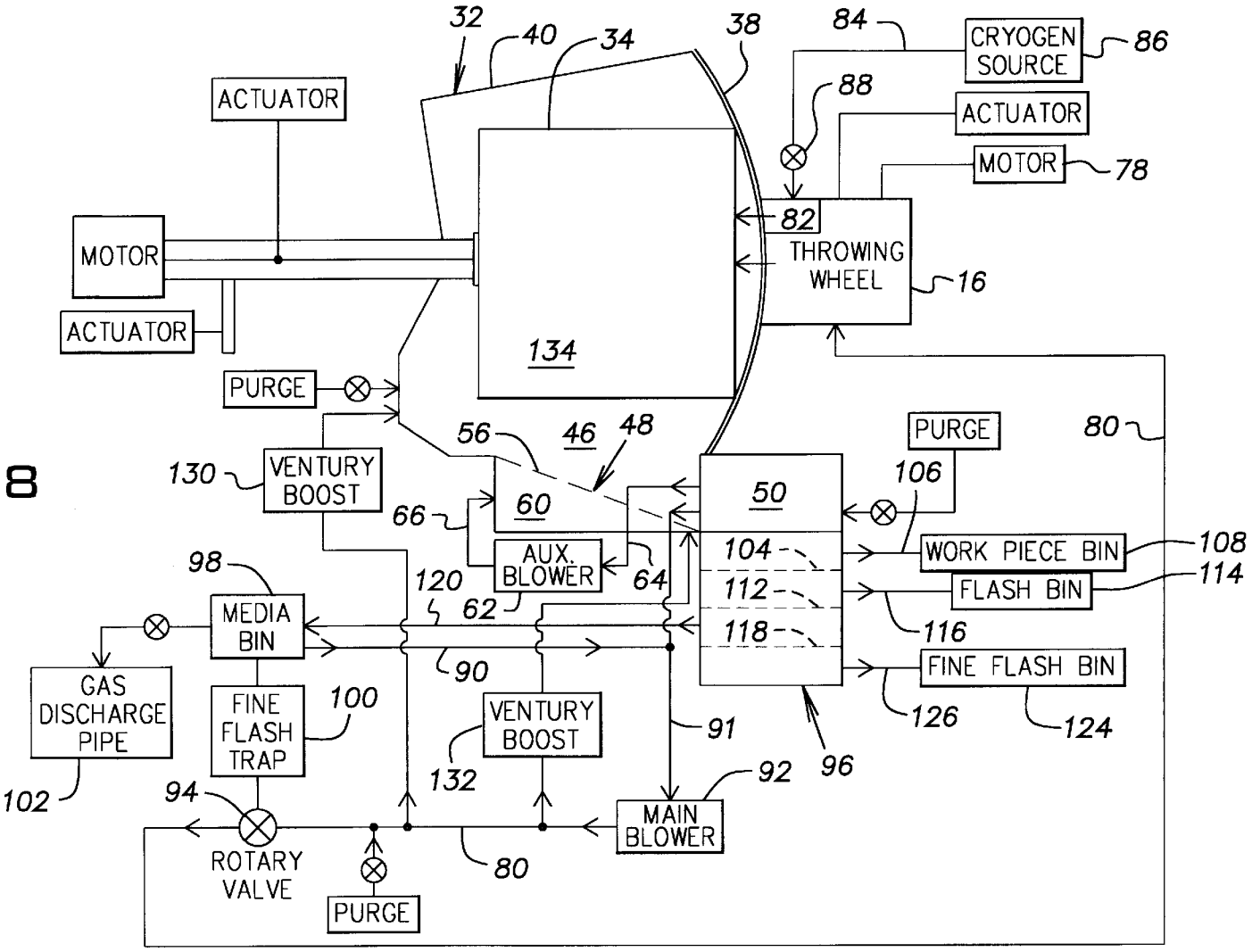
FIG. 8 is a block diagram of the cryogen shot-blast deflashing apparatus of FIGS. 1–7.

As best shown in FIGS. 2 and 8, a cryogen nozzle 82 is located above the throwing-wheel assembly 16. A valved cryogen-supply conduit 84 connects the nozzle 82 with a source of pressurized cryogen 86, such as liquid nitrogen, which is maintained at a temperature that is lower than such temperature as is desired to be maintained in the treatment chamber during operation of the deflashing apparatus 10. The valved conduit 84 includes a conventional power-operated valve 88 for controlling the flow of cryogen into the treatment chamber. The nozzle 82 is oriented to direct a two phase flow of cryogen into the barrel 34 to impact the work pieces.

Figure 7:
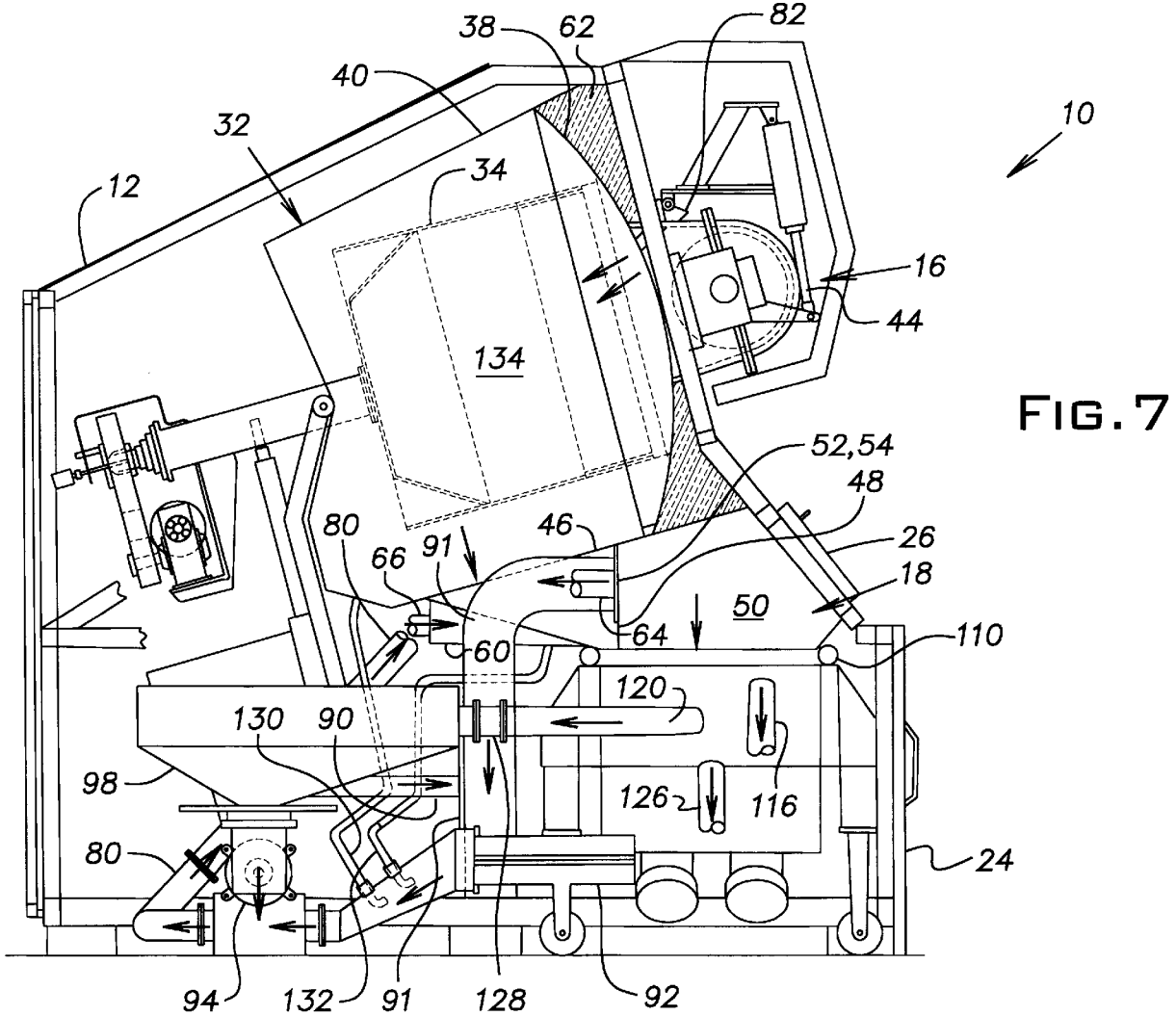
FIG. 7 is a side elevational view, similar to FIG. 2, showing various flow paths during operation of the apparatus of FIGS. 1–6.

As best shown in FIGS. 7 and 8, the closed recirculation system 18 includes the supply conduit 80 for supplying particulate media to the throwing-wheel assembly 16, first and second return or withdrawal conduits 90, 91 for withdrawing cryogen gas from the cryogenic chamber 32, a main blower 92 for moving cryogen gas in the supply and withdrawal conduits 80, 90, 91, a metering or rotary valve 94 for introducing a metered amount of particulate media into the flow of cryogen gas, and a vibratory separator unit 96 for separating work pieces, flash, and particulate media. The first and second withdrawal conduits 90, 91 each connect the recirculation-system plenum chamber 50, which is in communication with the cryogen chamber 32 through the drop chute 48, with the main blower 92. The first withdrawal conduit 90 connects the separator unit 96 to the inlet of the main blower 92 as will be described in more detail herein below. The second withdrawal conduit 91 connects the second exit 54 of the recirculation-system plenum chamber 50 to the inlet of the main blower 92.

The main blower 92 evacuates cryogen gas from the first and second withdrawal conduits 90, 91 which withdraws gas from the plenum chamber 50, through the second exit 54 and the separator unit 96 respectively, and delivers pressurized cryogen gas to the supply conduit 80 which returns cryogen gas to the throwing-wheel assembly 16. A variable speed drive motor is provided for driving the main blower 92. The main blower 92 operates in a push-pull fashion to establish a high velocity flow of cryogen gas through the treatment chamber by diminishing pressure within the withdrawal conduits 90, 91 to effectively evacuate gas from the cryogen chamber 32 and also by pressurizing the cryogen gas for delivery under pressure to the cryogen chamber 32 through the supply conduit 80 and the throwing-wheel assembly 16.

The rotary valve 94 is interposed in the supply conduit 80 for introducing a controlled flow of particulate media from the media hopper or bin 98 into the flow of pressurized cryogen gas which is being delivered by the supply conduit 80 to the throwing-wheel assembly 16. The rotary valve 94 includes a vaned rotor which is driven by a variable speed motor for dispensing a controlled flow of particulate media into the supply conduit 80. The particulate media is fed into the rotary valve 94 from the media bin 98 by gravity. A fine-flash trap 100 is preferably located between the rotary valve 94 and the media bin 98 to trap fine flash by a pressure drop to prevent fine flash from entering the media bin 98. The media bin 98 is also connected to a cryogen gas discharge pipe 102 for discharging cryogen gas from the recirculation system 18 when desired.

The separator unit 96 has a first screen 104 which effectively removes the work pieces to a drop chute or tray 106 (FIG. 1) which deposits the work pieces into a work piece hopper or bin 108 located adjacent the workpiece-bin door 22 (FIG. 1). The separator unit 96 is located below the plenum chamber 50 such that the first screen 104 substantially forms the bottom of the plenum chamber 50. A brush or gasket 110 attached to the top separator unit 96 provides a seal between the separator unit 96 and the plenum chamber 50. The first screen 104 preferably has openings of about ¼ inch.

A second screen 112 effectively removes large particles of flash for delivery to a flash hopper or bin 114, located adjacent the flash-bin door 24, through a conduit 116. The second screen 112 preferably is of No. 1 market grade, that is, has openings of about 0.073 inches.

A third screen 118 effectively removes reusable particulate media for delivery to the media bin 98, located adjacent the media-bin door 20 (FIG. 1), through a conduit 120. The third screen 118 preferably is 32 Tensile Bolt Cloth, that is, has openings of about 0.024 inches. It is noted, however, that each of the screens 104, 112, 118 are preferably changeable.

The first withdrawal conduit 90 connects a lower portion of the media bin 98 with the second withdrawal conduit 91 to connect the media bin 98 to the inlet of the main blower 92. The main blower 92 evacuates gas within the first withdrawal conduit 90 and the media bin 98 to form a vacuum therein. The vacuum formed in the media bin 98 draws or pulls particulate media into the media bin 98 through the conduit 120 from the separator unit 96 to substantially improve the transport system of the deflashing apparatus 10. The first withdrawal conduit 90 is preferably a smooth bore hose or pipe to increase vacuum in the media bin 98.

Figure 5:
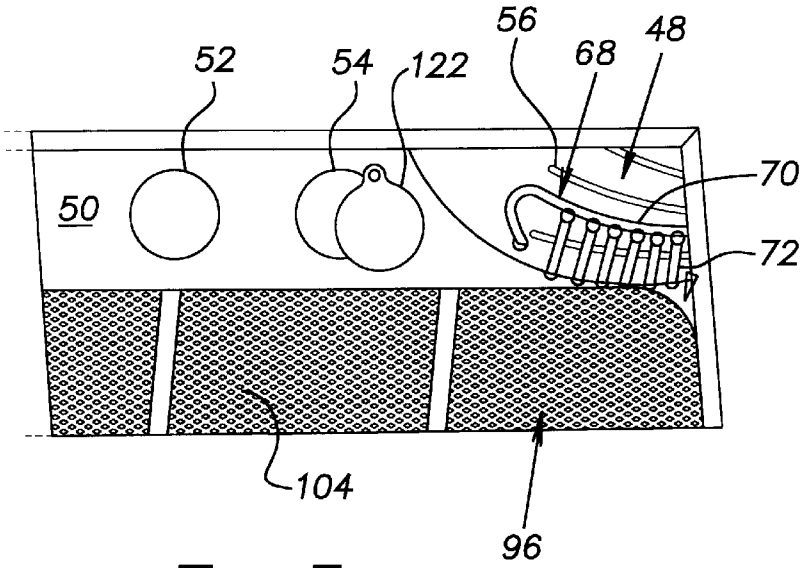
FIG. 5 is a perspective view looking through an access door of the apparatus of FIGS. 1–4 and showing a plenum chamber located above the separator unit.

As best shown in FIG. 5, the second withdrawal conduit 91 is preferably provided with a damper 122 which adjusts the flow of gas from the recirculation-system plenum chamber 50 to the main blower 92 without effecting the flow of gas from the media bin 98 to the main blower 92. The damper 122 is preferably closed during loading of the particulate media, prior to a deflashing operation, to obtain a greater vacuum in the media bin 98. The damper 122 is preferably open during a deflashing operation so that gas can pass therethrough to provide "make-up gas" if the pathway through the separator unit 96 and the media bin 98 becomes choke flowed. In the illustrated embodiment, the second exit 54 of the recirculation-system plenum chamber 50 is provided with a swing-gate which can be pivoted to adjust the second exit 54 from fully open to fully closed. It is noted that the second exit 54 and the second withdrawal conduit 91 can be eliminated, but the transport system will be less effective if the pathway through the separator unit 96 and the media bin 98 becomes choke flowed.

Smaller particles of flash and other waste particles pass through the third screen 118 and are delivered to a fine-flash bin 124, located adjacent the flash-bin door 24, through a conduit 126. A conventional vibratory system (not shown) is provided for effectively vibrating the separator unit 96 to separate the particulate media within the different stages. Each conduit attached to the separator unit 96 is preferably connected with a flexible coupling 128 to allow vibrational movement of the separator unit 96.

Venturi boost systems 130, 132 are preferably provided within the closed recirculation system 18. The illustrated deflashing apparatus 10 includes two venturi boost systems 130, 132. A fewer or greater number, however, could be utilized within the scope of the present invention. Each venturi boost system 130, 132 includes an inlet located in the supply conduit 80 between the main blower 92 and the rotary valve 94. The first venturi boost system 130 has an outlet at the bottom of the drum portion 40 of the cryogenic chamber 32 near the rearward end. The second venturi boost system 132 has an outlet in the bottom surface of the drop chute 48. Each venturi boost system 130, 132 receives a relatively high velocity flow of cryogen gas from the supply conduit 80 and passes the flow through a venturi nozzle to further increase the velocity of the flow. The flow of cryogen gas is then reinjected through the outlets at the various points within the closed recirculation system 18 to assist or boost the flow of particulate media. The venturi boost systems 130, 132 substantially increase the flow rate of particulate media through the recirculation system 18 by increasing the flow of particulate media and preventing the particulate from accumulating at various points within the recirculation system 18. It is noted that, alternatively, the venturi boost systems 130, 132 can be connected to a source of pressurized shop air or other source of pressurized gas to boost the particulate media with a stream of pressurized air or gas.

It is noted that because the supply and withdrawal conduits 80, 90, 91 are connected to stationary members, specifically the throwing-wheel assembly 16, the plenum chamber 50, the main blower 92, the rotary valve 94, and the media bin 98. The conduits 80, 90, 91, therefore, can be relatively rigid such as, for example, stainless steel tubes or pipes. Flexible and articulating components, which are relatively expensive, are thereby not required.

Operation of the deflashing apparatus 10 will be described with reference to FIGS. 7 and 8. During a deflashing operation, the barrel 34 is initially rotated to the loading position (FIG. 1) and a charge of work pieces to be deflashed is input into the barrel 34. The barrel 34 is then rotated to the operating position (FIG. 2) where the barrel 34 is in the sealed cryogenic chamber 32.

Initially, a pre-chill cycle cools the work pieces down to a desired temperature. Cryogen is introduced into the treatment chamber 134 through the valved conduit 84 and nozzle 82 and operation of the main blower 92 is initiated to circulate cryogen gas through the closed recirculation system 18 to prechill the work pieces so that they are ready for a deflashing operation. No particulate media, however, is introduced during this pre-chill cycle.

At the completion of the pre-chill cycle, a deflashing cycle begins. During the deflashing cycle, both cryogen and particulate media is introduced into the barrel 34 to impact the work pieces. A flow of cryogen gas and particulate media is delivered through the supply conduit 80 to the throwing-wheel assembly 16. The throwing-wheel assembly 16 projects a relatively high velocity flow of cryogen gas and particulate media into the treatment chamber 134 to impact the work pieces as the barrel 34 is rotated to impart a tumbling action to the work pieces so that all flash-carrying surfaces of the work pieces are exposed to the embrittling affect of the cryogen and the impact of the particulate media. It has been found that the required duration of the deflashing cycle can be substantially reduced by simultaneously varying the inclination angle of the barrel 34 and the direction of the flow of the particulate media from the throwing-wheel assembly 16 while the barrel 34 is rotating.

During rotation of the barrel 34, a flow of particulate (both flash and particulate media) discharges from the treatment chamber through openings in the barrel 34 and into the cryogenic chamber 32. The particulate flows out the cryogenic chamber 32 through the bottom opening 46 and into the drop chute 48. The particulate flows through the drop chute 48 and into the plenum chamber 50 where it falls onto the separator unit 96. During the deflashing cycle, the auxiliary blower 62 is operating so that pressurized gas flows out of the openings 56 in the drop chute 48 and assists the flow of particulate down the drop chute 48, ensuring that there is not a build up of particulate thereon.

At the same time, cryogen gas discharges from the treatment chamber through the openings in the barrel 34 to the cryogenic chamber 32. The gas flows out of the cryogenic chamber 32 through the bottom opening 46 to the drop chute 48 and through the drop chute 48 to the plenum chamber 50. The gas flows out of the plenum chamber 50 through three paths: the first exit 52, the second exit 54, and the separator unit 96.

Gas is pulled through the first exit 52 and the conduit 64 by the auxiliary blower 62. The auxiliary blower 62 pressurizes the gas and pushes it through the conduit 66 into the drop-chute plenum chamber 60. Pressurized gas within the by the drop-chute plenum chamber 60 exits through the plurality of slots 56 to assist the flow of particulate through the drop chute 48.

Gas is pulled through the second exit 54 and the separator unit 96 by the main blower 92. The main blower 92 pulls the gas through the separator unit via the conduit 120, the media bin 98, and the first withdrawal conduit 90. The main blower 92 pulls the gas through the second exit 54 via the second withdrawal conduit 91.

The main blower 92 pressurizes the withdrawn cryogen gas and pushes it into the supply conduit 80 through which it travels at a relatively high velocity back to the throwing-wheel assembly 16. The separator unit 96 separates reusable particulate media and ducts it, via conduit 120, into the media bin 98, from where the particulate media flows under the influence of gravity, and controlled by the rotary valve 94, into the supply conduit 80 for return to the throwing-wheel assembly 16. Waste particulate including pieces of flash and the like are ducted by the separator unit 96 into the flash bins 114, 124.

At the completion of the deflashing cycle, a post-tumble cycle begins wherein the cryogen valve 88 is closed and the main blower 92, the rotary valve 94, and the throwing wheel assembly 16 are stopped. The barrel 34, however, continues to rotate and the separator unit 96 continues to separate particulate falling from the barrel 34. Preferably, the auxiliary blower 62 continues to operate so that flowing gas decreases the drying time of the work pieces.

At the completion of the post-tumble cycle, a dump cycle begins. During the dump cycle, the barrel 34 is pivoted forward to a dumping position wherein the front of the barrel 34 just above the spacer 68. In this position, the barrel 34 is spaced above the drop chute 48 so that the contents are dumped onto the separator unit 96 whereupon the deflashed work pieces are discharged into the work piece bin 108 which can be removed through the work-piece-bin door 22. In preferred practice, the work-piece-bin door 22 is kept open for as short a time as possible to minimize the escape of cryogen gas and to minimize the entry of ambient moisture.

If desired, a drying cycle can begin after the dumping cycle to dry the particulate media. After the work pieces are removed, the barrel 34 is returned to an operating position (FIG. 2) and the particulate media is circulated through the closed recirculation system. The circulation of the particulate media and gas or air thereby dries the particulate media. When an additional deflashing operation is desired, the above-described procedure is repeated.

The illustrated apparatus can be advantageously operated to both tumble and deflash work pieces in a shorter period of time than would be required for separate operations in a tumbling apparatus and a separate deflashing apparatus. The combined tumble and deflash operation is the same as the deflashing operation described hereinabove except that tumbling particulate media is inserted into the barrel 34 along with the work pieces. Additionally, the first screen 104 of the separator unit is replaced with a bar grate so that the tumbling particulate media will pass through to the flash bin 114. Alternatively, a bar grate can be placed between the tray 106 and the work piece bin 108 outside the work-piece-bin door 22. The remainder of the combined operation is the same as the above-described deflashing operation. It is noted that the tumbling particulate media can advantageously be rubber elements, either molded to a particular weight and shape or old junk parts. The rubber elements can be sized and shaped to have a warmer embrittlement temperature than prior art tumbling particulate media.

As will be apparent from the foregoing description, the system of the present invention has novel and improved features that include advances in both method and apparatus. The system provides a significant improvement in the transfer rate of particulate media through the deflashing apparatus 10 and therefore provides a significantly shorter processing time. In operational tests, the deflashing apparatus has been found to carry out deflashing procedures expeditiously and reliably with a wide variety of different types of work pieces.

Although particular embodiments of the invention have been described in detail, it will be understood that the invention is not limited correspondingly in scope, but includes all changes and modifications coming within the spirit and terms of the claims appended hereto.

What is claimed is:

1. A cryogen shot blast apparatus for deflashing work pieces, said apparatus comprising:

a treatment chamber for the work pieces;

a throwing wheel adapted to propel particulate media into the treatment chamber to impact the work pieces in the treatment chamber;

a cryogen supply system for introducing a flow of cryogen into the treatment chamber for embrittling at least selected portions of the work pieces in the treatment chamber;

a recirculation system including a separator unit in communication with the treatment chamber, a media hopper in communication with said separator unit, a blower connected to said media hopper by a withdrawal conduit for withdrawing cryogen gas from the treatment chamber through said separator unit and said media hopper and pulling particulate media from said separator unit to said media hopper, and a supply conduit connecting said blower and said throwing wheel to return pressurized cryogen gas to said throwing wheel; and a particulate media supply system for introducing a metered flow of particulate media from said media hopper into flowing cryogen gas in said supply conduit to transport particulate media to said throwing wheel.

2. The cryogen shot blast apparatus according to claim 1, wherein said recirculation system has a second withdrawal conduit connected to said blower and in communication with said treatment chamber for withdrawing cryogen gas from the treatment chamber without passing through said separator unit.

3. The cryogen shot blast apparatus according to claim 2, wherein said second withdrawal conduit is provided with a damper adapted to vary flow through said second conduit.

4. The cryogen shot blast apparatus according to claim 2, further comprising a plenum chamber formed above said separator unit and in communication with said treatment chamber, and wherein said second withdrawal conduit is in communication with said plenum chamber for withdrawing gas therefrom.

5. The cryogen shot blast apparatus according to claim 4, wherein said second withdrawal conduit is provided with a damper adapted to vary flow through said second withdrawal conduit.

6. The cryogen shot blast apparatus according to claim 5, wherein said damper is a swing gate attached to a wall of said plenum chamber.

7. The cryogen shot blast apparatus according to claim 1, further comprising a drop chute connecting said treatment chamber and said recirculation system to direct particulate from said treatment chamber to said separator unit, said drop chute having a downwardly sloped upper surface toward said separator unit and a plurality of spaced-apart openings along said upper surface for introducing streams of pressurized gas to assist movement of particulate through said drop chute from said treatment chamber to said recirculation system.

8. The cryogen shot blast apparatus according to claim 1, further comprising a cryogenic chamber, a barrel supported within said cryogenic chamber and defining said treatment chamber, said barrel being rotatable about a longitudinal axis and pivotable to a dumping position wherein work pieces in said barrel are dumped from said barrel through an open end of said barrel, and a spacer located above said drop chute.

9. A cryogen shot blast apparatus for deflashing work pieces, said apparatus comprising:

a treatment chamber for the work pieces;

a throwing wheel adapted to propel particulate media into the treatment chamber to impact the work pieces in the treatment chamber;

a cryogen supply system for introducing a flow of cryogen into the treatment chamber for embrittling at least selected portions of the work pieces in the treatment chamber;

a recirculation system including a separator unit in communication with the treatment chamber, a withdrawal conduit in communication with said treatment chamber, a supply conduit connecting said withdrawal conduit and said throwing wheel to return pressurized cryogen gas to said throwing wheel, and a main blower connected to said withdrawal conduit for withdrawing cryogen gas from the treatment chamber and connected to said supply conduit for returning pressurized cryogen gas to said throwing wheel;

a drop chute connecting said treatment chamber and said recirculation system to direct particulate from said treatment chamber to said separator unit, said drop chute having a downwardly sloped upper surface toward said separator unit and a plurality of spaced-apart openings along said upper surface for introducing streams of pressurized gas to assist movement of particulate through said drop chute from said treatment chamber to said recirculation system; and a particulate media supply system for introducing a metered flow of particulate media into flowing cryogen gas in said supply conduit to transport particulate media to said throwing wheel.

10. The cryogen shot blast apparatus according to claim 9, further comprising an auxiliary blower, separate from said main blower, in communication with said plurality of openings for providing pressurized gas thereto.

11. The cryogen shot blast apparatus according to claim 10, further comprising a plenum chamber formed above said separator unit and in communication with said treatment chamber, wherein said auxiliary blower is in communication with said plenum chamber for withdrawing gas therefrom.

12. The cryogen shot blast apparatus according to claim 9, wherein said drop chute has a plenum chamber formed below said upper surface and in communication with said plurality of openings.

13. The cryogen shot blast apparatus according to claim 12, further comprising an auxiliary blower in communication with said plenum chamber providing gas thereto.

14. The cryogen shot blast apparatus according to claim 13, further comprising a recirculation-system plenum chamber formed above said separator unit and in communication with said treatment chamber, and wherein said auxiliary blower is in communication with said recirculation-system plenum chamber for withdrawing gas therefrom.

15. The cryogen shot blast apparatus according to claim 9, wherein at least some of said openings are transversely extending slots.

16. The cryogen shot blast apparatus according to claim 9, wherein said upper surface of said drop chute has a downwardly angled longitudinal axis and at least some of said openings are slots at an angle relative to said longitudinal axis.

17. A cryogen shot blast apparatus for deflashing work pieces, said apparatus comprising:

a cryogenic chamber;

a barrel supported within said cryogenic chamber and defining a treatment chamber for the work pieces, said barrel being rotatable about a longitudinal axis and pivotable to a dumping position wherein work pieces in said barrel are dumped from said barrel through an open end of said barrel;

a throwing wheel adapted to propel particulate media into the treatment chamber to impact the work pieces in the treatment chamber;

a cryogen supply system for introducing a flow of cryogen into the treatment chamber for embrittling at least selected portions of the work pieces in the treatment chamber;

a recirculation system including a separator unit in communication with the treatment chamber, a withdrawal conduit in communication with said treatment chamber, a supply conduit connecting said withdrawal conduit and said throwing wheel to return pressurized cryogen gas to said throwing wheel, and a main blower connected to said withdrawal conduit for withdrawing cryogen gas from the treatment chamber and connected to said supply conduit for returning pressurized cryogen gas to said throwing wheel;

a drop chute connecting said cryogenic chamber and said recirculation system to direct particulate from said treatment chamber to said separator unit, said drop chute having a downwardly sloped upper surface toward said separator unit;

a spacer located above said drop chute;

wherein said spacer includes a main rod having a central portion spaced from said upper surface and a plurality of spaced apart fingers extending between said upper surface and said main rod; and a particulate media supply system for introducing a metered flow of particulate media into flowing cryogen gas in said supply conduit to transport particulate media to said throwing wheel.

18. The cryogen shot blast apparatus according to claim 17, wherein said spacer is adapted to allow particulate media to pass therethrough.

19. The cryogen shot blast apparatus according to claim 17, said drop chute having a plurality of spaced-apart openings along said upper surface for introducing streams of pressurized gas to assist movement of particulate through said drop chute from said treatment chamber to said recirculation system.

* * * * *